US007183712B2

(12) United States Patent
Schoeller et al.

(10) Patent No.: US 7,183,712 B2
(45) Date of Patent: Feb. 27, 2007

(54) LAMP FOR A VEHICLE HEADLIGHT WITH LOW-BEAM FUNCTION

(75) Inventors: Klaus Schoeller, Nideggen (DE); Colette Knight, Aachen (DE); Ralf Schaefer, Aachen (DE); Lukas Kuepper, Aachen (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 82 days.

(21) Appl. No.: 10/502,184

(22) PCT Filed: Dec. 2, 2003

(86) PCT No.: PCT/IB03/05588

§ 371 (c)(1),
(2), (4) Date: Jul. 21, 2004

(87) PCT Pub. No.: WO2004/053924

PCT Pub. Date: Jun. 24, 2004

(65) Prior Publication Data

US 2005/0212434 A1 Sep. 29, 2005

(30) Foreign Application Priority Data

Dec. 10, 2002 (EP) ..... 02102711

(51) Int. Cl.
*H01J 5/16* (2006.01)
*H01J 61/40* (2006.01)
*H01J 61/35* (2006.01)

(52) U.S. Cl. ..... 313/635; 313/116; 313/110; 313/111; 313/117; 362/351

(58) Field of Classification Search ..... 313/635, 313/110–112, 117, 116, 114; 362/351; 118/50
See application file for complete search history.

(56) References Cited

U.S. PATENT DOCUMENTS

| | | | | |
|---|---|---|---|---|
| 1,522,252 | A | 1/1925 | Luyties | |
| 5,111,105 | A * | 5/1992 | Yamamoto | 313/112 |
| 5,578,892 | A * | 11/1996 | Whitman et al. | 313/112 |
| 5,578,893 | A * | 11/1996 | Yamamoto | 313/112 |
| 6,281,630 | B1 * | 8/2001 | English et al. | 313/635 |
| 6,611,101 | B1 * | 8/2003 | Mitobe et al. | 313/635 |
| 2002/0021065 | A1 * | 2/2002 | Gervelmeyer et al. | 313/112 |
| 2004/0174121 | A1 * | 9/2004 | Tsuda et al. | 313/635 |
| 2005/0236960 | A1 * | 10/2005 | Kupper et al. | 313/489 |

FOREIGN PATENT DOCUMENTS

WO WO0184596 A1 11/2001

* cited by examiner

*Primary Examiner*—Nimeshkumar D. Patel
*Assistant Examiner*—Peter Macchiarolo

(57) ABSTRACT

The invention relates to a lamp for a vehicle headlight with low-beam function, which lamp has an outer envelope and emits at least visible light of different colors from several regions of the outer envelope, characterized in that in that a partial coating is at least provided on the outer envelope such that, when the low-beam function is being realized, at least that region of the traffic space which lies above the bright-dark cut-off can be at least partly illuminated with visible colored light which is scattered at said partial coating, while at the same time that region of the traffic space which lies below the bright-dark cut-off can be illuminated with visible light of a different color in defined regions.

25 Claims, 3 Drawing Sheets

LAMP FOR A VEHICLE HEADLIGHT WITH LOW-BEAM FUNCTION

Figure 1A:
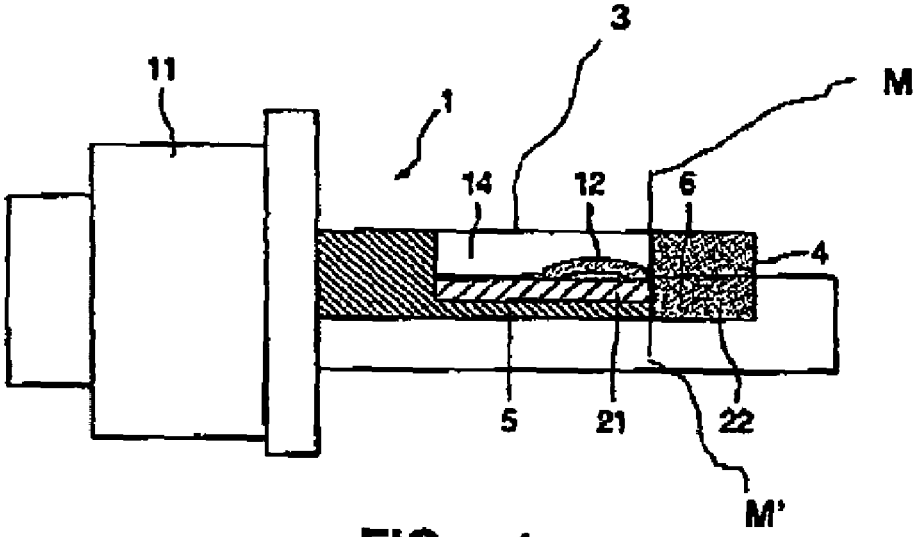

The invention relates to a lamp for a vehicle headlight with low-beam function. The lamp has an outer envelope and emits at least visible light of different colors from several regions of the outer envelope.

The expression "outer envelope" relates to the outermost envelope in the case of lamps having several envelopes and, in the case of lamps having only a single envelope, to this single envelope within the context of the present invention.

Vehicle headlights with low-beam function as that term is used with regard to the field of the invention are all those headlights which generate a bright-dark cut-off, such as, for example, pure low-beam headlights, combined high- and low-beam headlights, pure fog headlights, combined low-beam and fog headlights, and curve illumination headlights.

Lamps used for this field of application are incandescent lamps, in particular halogen lamps with one or two incandescent filaments, or high-pressure gas discharge lamps. Lamps to be used in vehicle headlights are subject to international standards setting or to some extent determining their main design parameters. For example, the SAE or ECE standards relate in particular to the European or the US market. Properties, for example, color properties to be achieved are exactly defined for all cases.

Usually, headlights with a low-beam function are fitted with lamps which radiate visible light of substantially the same color in all spatial directions, so that in that case usually a traffic space illuminated with a homogeneous color is obtained.

The respective desired or required light color can be achieved by means of conventional coatings which are provided, in particular, on the outer surface of the outer envelope of the lamp in a known manner.

It is known that bluish light is better reflected against obstacles in the traffic space, for example traffic signs, and can thus be better or earlier observed, in particular by the driver of the vehicle, as it illuminates the respective traffic space, so that traffic safety is usually enhanced thereby. Yellow light, by contrast, leads to a lower glare sensitivity on the part of a driver of an oncoming vehicle. It is furthermore known that the human eye has not only an achromatic sensitivity, which can be described inter alia by the standardized sensitivity curve $V(\lambda)$, but also a chromatic sensitivity which depends extremely strongly on the parameters of ambient lighting and duration of glare. The chromatic sensitivity in the blue spectral range depends very strongly on the duration of a glare-generating illumination. For example, if the duration of the glare rises from 5 ms to 1 s, the spectral sensitivity of the eye is raised fivefold. This is true in particular for the peripheral vision regions of the eye under mesoscopic viewing conditions. Mesoscopic viewing conditions obtain when the color-sensitive (daylight vision) and the color-insensitive (night vision) visual cells are addressed to the same degree. Color-sensitive visual cells are predominantly addressed in daylight vision and color-insensitive visual cells in night vision.

The integral spectral intensity distribution of a high-pressure gas discharge lamp, such as a so-termed "xenon lamp," is two to three times higher in the short-wave (blue) spectral range than that of a halogen lamp. Experiments with test subjects have led to the result that the luminance of a halogen lamp must be 25 to 50% higher than the luminance of a xenon lamp so as to achieve the same glare effect. A reduction of the luminance of a xenon lamp in the short-wave (blue) spectral range, and accordingly a reduction in glare of oncoming drivers, can be adjusted by means of a yellow coating on the lamp envelope. Such yellow coated xenon or halogen lamp envelopes are known.

U.S. Pat. No. 5,578,893 discloses a halogen lamp for a vehicle headlight which has two incandescent wires and which is capable of realizing both the low-beam and the high-beam function. One incandescent wire, i.e. the low-beam incandescent wire, is arranged adjacent the tip of the glass bulb, and the second, high-beam incandescent wire is arranged adjacent the pinch of the glass bulb. A region impermeable to light at the tip of the outer envelope merges into a coated region which is in communication with the low-beam incandescent wire which is arranged adjacent the tip of the glass bulb and which exclusively serves the low-beam function. The homogeneous coating is dimensioned and arranged as regards its size and shape such that it is assured that the light emitted by the low-beam incandescent wire must pass substantially fully through this coated region in order to be able to leave the lamp. When the low-beam function is realized, therefore, the light emitted by this incandescent wire passes almost exclusively through said coated region of the outer bulb. This coating, which absorbs in the blue spectral range, is chosen such that the visible light issuing to the exterior has in particular a yellowish color. When the low-beam function is realized, the entire traffic space then illuminated by the vehicle is accordingly homogeneously illuminated with yellowish light. The advantages of a bluish light, however, cannot be utilized when the low-beam function is realized. Obstacles or traffic signs present at the right-hand road side, i.e. seen in the driving direction of the vehicle in the case of right-hand traffic, are difficult to observe for the driver of the vehicle.

In the prior art, furthermore, two different types of vehicle headlights are distinguished, i.e. projection and reflection headlights. Only projection headlights have offered the possibility until now of illuminating the traffic space inhomogeneously as regards color. This direction-dependent colored illumination of the traffic space is caused in particular by the projection lens and not by the lamp itself. Such headlights cause a glare effect owing to white or blue stray light in the region above the bright-dark cut-off, which is perceived as unpleasant by oncoming drivers. Projection headlights sometimes have a brightness-enhancing optical system, which cause additional white or blue stray light.

It is an object of the invention to provide a lamp with such a coating or a lighting device with such a lamp which can be efficiently manufactured in an industrial mass manufacturing process and which renders possible a better traffic safety when the low-beam function is realized without increasing the glare sensitivity.

The object of the invention is achieved in that a partial coating is at least provided on the outer envelope such that, when the low-beam function is being realized, at least that region of the traffic space which lies above the bright-dark cut-off can be at least partly illuminated with visible colored light which is scattered at said partial coating, while at the same time that region of the traffic space which lies below the bright-dark cut-off can be illuminated with visible light of a different color in defined regions.

A partial coating, which does not cover the entire region from which the emitted light issues from the outer envelope of the lamp during realization of the low-beam function in the context of the invention, may be homogeneous or inhomogeneous in particular as regards layer structure, thickness, and composition in dependence on the desired function of the coating or of the portions of the coating. Such a coating may consist of several different portions according to the invention, which portions are arranged on the outer envelope in a defined manner in dependence on their respective functions.

In countries with right-hand traffic such as, for example, Germany, the partial coating is to be chosen and arranged according to the invention in such a manner that, viewed in the driving direction of the vehicle, the right-hand road side or in particular the outermost region thereof is illuminated with bluish light, whereas the left-hand road side is illuminated with yellowish light, while the region above the bright-dark cut-off is illuminated with yellowish scattered light. The lamp according to the invention thus combines the advantages of the known lamps, which have a full coating in this respect for influencing the light color when the low-beam function is realized. The glare sensitivity of oncoming traffic is reduced, while at the same time an improved visibility of objects in the peripheral visual range is achieved for the right-hand and left-hand road sides. The invention applies equally well to left-hand traffic, with suitable modifications.

It is preferred, in particular, that the partial coating or at least a portion of this coating is an absorption coating which transmits in particular yellow light. Dichroic coatings extending over the entire lamp envelope often lead to a direction-dependent color distribution which causes a stronger glare for the oncoming traffic than an absorption coating, which is usually undesirable.

By contrast, partial dichroic coatings cause a substantially lesser glare arising from uncontrolled reflected light. It is accordingly useful in certain cases that the partial coating or a portion of this coating is an interference coating or a combined absorption and interference coating. This may be the case, for example, if the color point of the pigments used lies outside the color regions standardized in the SAE or ECE guidelines. A suitable interference coating is capable of shifting the color distribution into the desired color range.

It is furthermore preferred that at least a portion of the partial coating on the outer envelope is arranged in a striped pattern extending substantially parallel to the axis of the light source or along the pinstripes. If lamps with so-termed "pinstripes" are used, which serve to screen off that light that would dazzle the oncoming traffic, a striped arrangement of the partial coating along the pinstripes achieves that the traffic space below the bright-dark cut-off is illuminated with bluish light. Blue light leads to a substantially earlier recognition of traffic signs or any obstacles in the traffic space, in particular in the peripheral visual range along the bright-dark cut-off.

It is furthermore preferred that a partial coating, in particular a yellow absorption layer, is arranged in a defined manner, in particular on the frontmost region of the lamp envelope. This region extends preferably from the lamp tip up to the end of the return lead. The yellow light scattered against the pigments of this coating is not imaged in defined regions of the traffic space, but rather is scattered over the entire traffic space, i.e. also into the high-beam distance. Yellow scattered light in the glare region of the high-beam space is superimposed on the other scattered light such that oncoming drivers experience a reduced glare impression because of the lower sensitivity of the eye in the yellow spectral range.

It is furthermore preferred that the partial coating comprises at least a portion which is an absorption coating, from which in particular yellow light is issued and which is arranged in the frontmost and/or rearmost region of the lamp envelope, and a portion which is arranged in a striped pattern along the pinstripes and from which in particular blue light is issued.

The invention is furthermore achieved in a lighting unit which comprises at least one lamp for a vehicle headlight with low-beam function, which has an outer envelope and emits at least visible light of different colors from several regions of the outer envelope, having at least a partial coating on the outer envelope such that, when the low-beam function is being used, at least that region of a traffic space which lies above the bright-dark cut-off can be at least partly illuminated with visible colored light scattered at the partial coating, while at the same time that region of the traffic space which lies below the bright-dark cut-off can be illuminated with visible light of a different color in defined regions. The light source of the lamp of the lighting unit may be a high-pressure discharge lamp or an incandescent lamp, in particular a halogen lamp. The partial coating of the lamp of the lighting unit or at least a portion of this coating may be an absorption coating which scatters, in particular, at least partly, yellow light. A lamp partial coating or at least a portion of this coating may be an interference coating or a combined absorption and interference coating which transmits, in particular, blue light. A partial coating, in particular a yellow absorption layer, may be arranged in a defined manner on, in particular, the front or rear region of the lamp's outer envelope. At least a portion of the partial coating may have a protion having an absorption coating which scatters, in particular, at least partly, yellow light and a portion which is arranged in a striped pattern along pinstripes. At least one partial coating of a lamp of the lighting system may extend in a striped pattern along the lamp envelope axis and transmit bluish light.

Figure 1B:
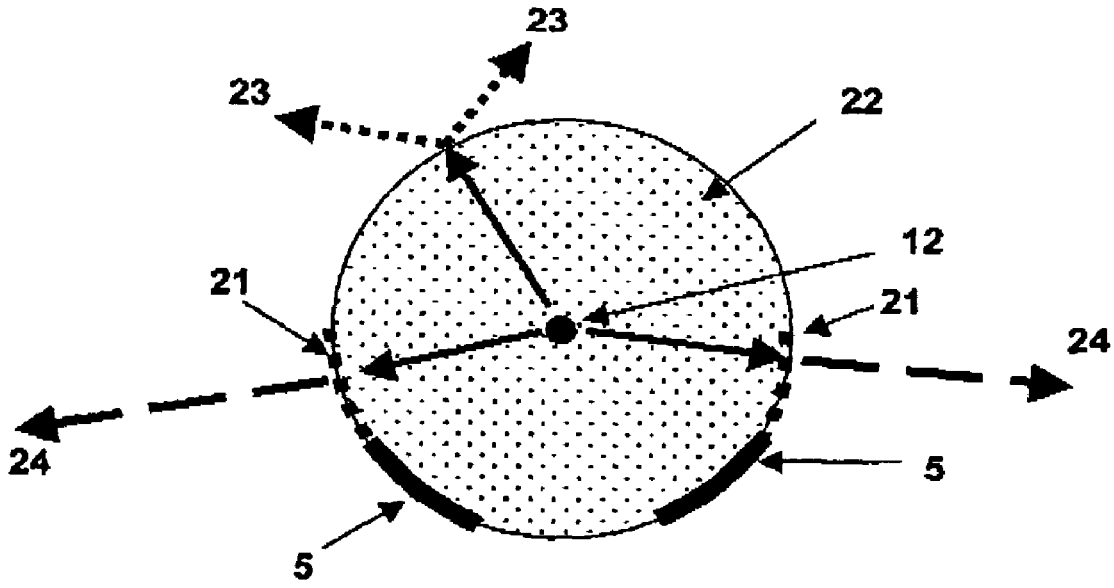

Farther particulars, features, and advantages of the invention will become apparent from the ensuing description of two preferred embodiments, which is given with reference to the drawing, in which:

FIG. 1*a* is a diagrammatic side elevation of a xenon lamp for a reflection headlight, FIG. 1*b* is a cross section of the xenon lamp of FIG. 1*a,*

Figure 2:
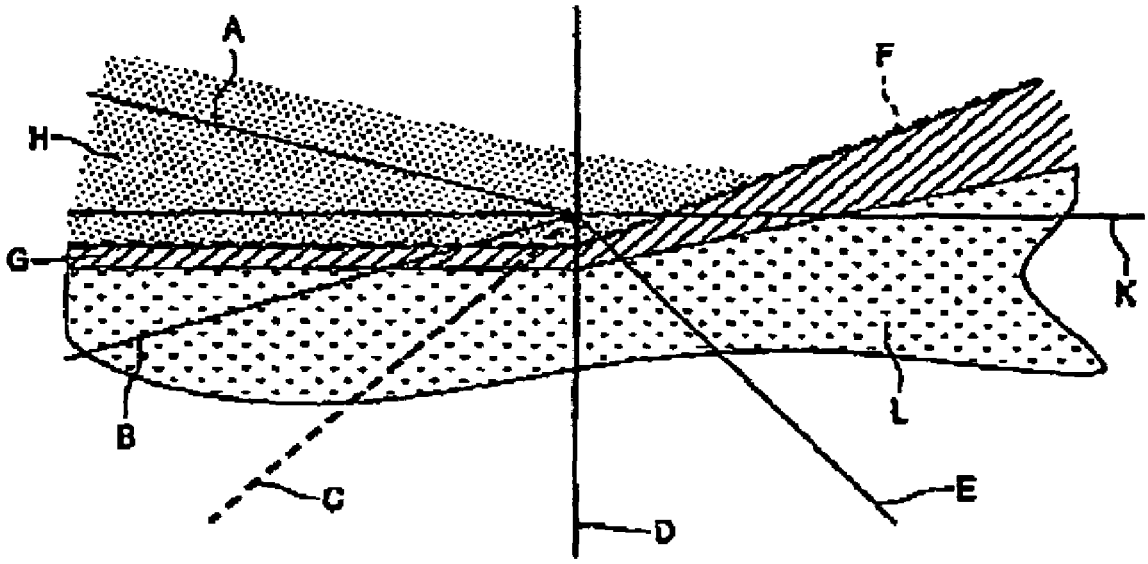

FIG. 2 diagrammatically shows an illumination distribution in the traffic space of a lamp of FIG. 1*a,*

Figure 3:
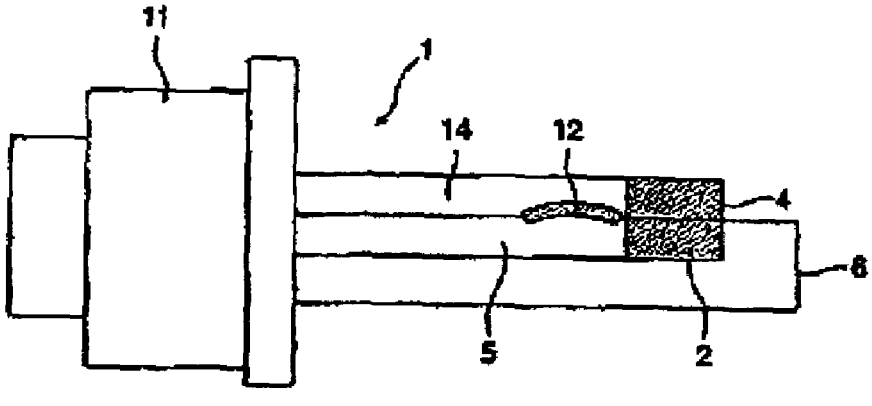
Figure 4:
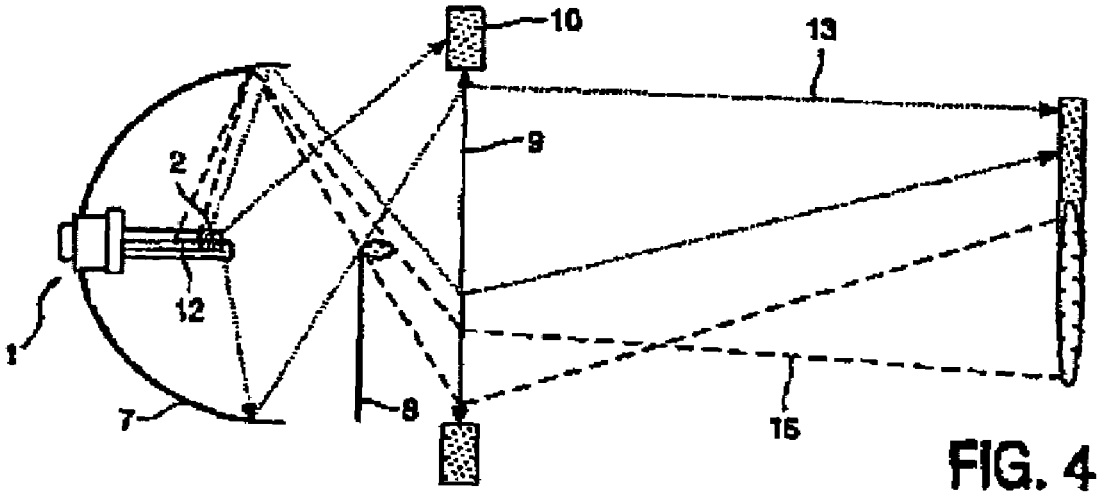
Figure 5:
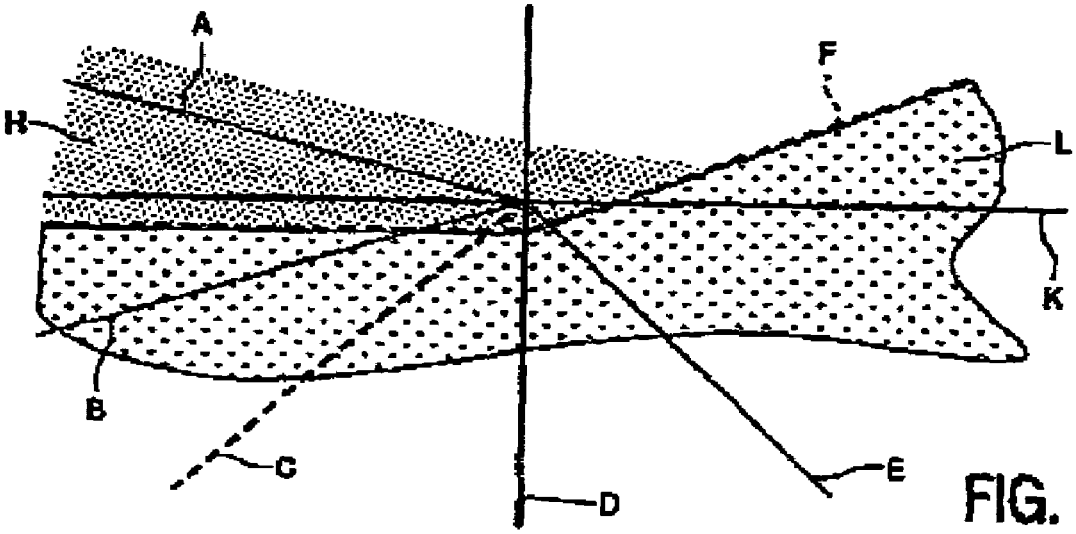

FIG. 3 is a diagrammatic side elevation of a xenon lamp for a projection headlight, FIG. 4 is a diagrammatic picture of a xenon lamp in a projection headlight, and FIG. 5 diagrammatically shows the illumination distribution in the traffic space of a lamp of FIG. 3.

FIG. 1*a* is a diagrammatic side elevation of a first embodiment of a xenon lamp 1 according to the invention for a reflection headlight. A luminous discharge arc 12 is diagrammatically shown in FIG. 1*a* as the actual light source inside the lamp envelope 3, which is connected to a lamp base 11. The luminous discharge arc 12 is formed in a known manner between the two electrodes, the electrode remote from the lamp base 11 being denoted the return lead 6. The partial coating 2 comprises the portions 21 and 22 and is arranged in total only on a portion of the outer surface of the outer envelope 4. Two pinstripes 5, of which only one pinstripe 5 is visible in FIG. 1*a,* are arranged on the outer envelope 4, and in their immediate vicinity there are two striped portions 21 of the partial coating 2, of which only one striped portion is visible in FIG. 1*a.* The outer envelope 4 in addition has a region 14 which has no coating, so that unfiltered light issues predominantly from this region. The portion 22 of the partial coating 2 is formed by an absorption coating.

The coating 2 is a so-termed "sol-gel" coating in which organic or inorganic pigments are embedded in a silicon dioxide network. Depending on the desired color impression and the desired temperature stability of the coating 2, mixtures of different pigments may alternatively be used. In addition to solvents such as, for example, diacetyl alcohol necessary for the deposition, the use of means for supporting an optimum cross-linking is useful, such as, for example, pigments mixed with an alkoxysilane compound.

The requirements imposed on the temperature stability of the partial coating 2 are determined in particular by the temperatures of 900 to 950° C. to which the outer envelope 4 of the high-pressure discharge lamp is regularly exposed. Pigments complying with these requirements and generating a blue color impression through the two striped portions 2 are, for example, pigments comprising Co—Al. A good transparency and a low stray light component are achieved inter alia when the particle size of the pigments is preferably below 100 nm.

FIG. 1*b* is a cross section of the xenon lamp of FIG. 1*a* along a section M–M' as shown in FIG. 1*a*. Two pinstripes 5 are shown as are two striped portions 21. The portion 22 of the partial coating 2 is present on the top of the light source, the luminous discharge arc 12. Light from the discharge arc 12 is transferred as yellow scattered light 23 above the cut-off, while the light 24 transmitting through the striped portions 21 of the partial coating 2 is projected close to the bright dark cut-off (line F in FIG. 2).

The coating 2 is provided in a pressure spraying process in a manner, known to those of skill in the art. After the coating process, it is favorable to allow the coating 2 to cure for 5 to 10 minutes at approximately 250° C.

Alternatively to the portion 21, a blue multiple-layer interference filter may be provided along the pinstripes 5 on the surface of the outer envelope 4 in a sputter coating process. The width of the stripe should preferably be less than or equal to 3 mm.

FIG. 2 diagrammatically shows the illumination distribution of the lamp 1 according to the invention on a vertical screen, for example 10 m in front of the vehicle when the low-beam function is being realized in accordance with FIG. 1*a*. FIG. 2 contains a line A which is the line on which the eyes of a driver of oncoming traffic move; B the line of the left-hand driving lane edge; C the central line of the driving lane; D the line representing the center of the right-hand driving lane; E the line of the right-hand driving lane edge; and F the line of the bright-dark cut-off; with G being the region of the blue stray light which is bounded at the upper side by the line F of the bright-dark cut-off, and with H being the region of the yellow stray light. Light passing through the portion 22 of the partial coating 2 is imaged adjacent the bright-dark cut-off F in the traffic space. K denotes the horizon line, and L the region illuminated by unfiltered light. The bright-dark cut-off F is that region in the traffic space which separates the traffic space illuminated by the headlight from the traffic space not illuminated thereby. A portion of the emitted light incident on the portion 22 is scattered into the glare region, which lies above the bright-dark cut-off F, and is superimposed on the unfiltered stray light of the lamp 1 present there.

FIG. 3 is a diagrammatic side elevation of a further embodiment of a xenon lamp 1 according to the invention for a projection headlight. The partial coating 2 in this embodiment is provided on the surface of the outer envelope 4 in the region between the return lead 6 and the end of the outer envelope 4 in the form of a homogeneous, closed, yellow BiVO4 absorption layer. The pinstripes 5 are also provided on the outer envelope 4. The remaining region of the surface of the outer envelope 4 is substantially formed by a region 14 which has no coating.

FIG. 4 diagrammatically shows a xenon lamp with a partial coating 2 arranged in a projection headlight. The lamp 1 is positioned in an elliptical mirror 7. The lighting unit comprises in addition inter alia a diaphragm 8, a lens 9, and a conventional contrast-reducing optical system 10. FIG. 4 shows the radiation path 15 of that portion of the emitted light that passes through the region 14 with a broken line and the radiation path 13 issuing from the partial coating 2 with a dotted line.

FIG. 5 is a diagrammatic picture analogous to that of FIG. 2 of the illumination distribution in the traffic space of the second embodiment when the low-beam function is being realized.

A portion of the yellow light scattered against the coating 2 also enters the glare region H of the oncoming driver, in contrast to non-scattered, unfiltered light. Since the human eye is less sensitive in the yellow spectral region than in the blue spectral region, the glare effect is clearly weaker in the former region. The light passing through the yellow absorption layer 2 without scattering and portions of the yellow light scattered against the coating 2 enter the traffic space to be illuminated, i.e. the region L in FIG. 5, as does the unfiltered light.

Finally, the above-discussion is intended to be merely illustrative of the present invention and should not be construed as limiting the appended claims to any particular embodiment or group of embodiments. Each of the systems utilized may also be utilized in conjunction with further systems. Thus, while the present invention has been described in particular detail with reference to specific exemplary embodiments thereof, it should also be appreciated that numerous modifications and changes may be made thereto without departing from the broader and intended spirit and scope of the invention as set forth in the claims that follow. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference numerals in the claims are for illustration purposes only and do not limit their protective scope; and d) several "means" may be represented by the same item or hardware or software implemented structure or function.

The invention claimed is:

1. A lamp for a vehicle headlight having a low-beam function capable of generating a bright-dark cut-off for emitted light, the lamp comprising:

an outer envelope configured to emit at least visible light of different colors from several regions of the outer envelope, wherein:

a first coating and a second coating provided on at least part of the outer envelope, wherein at least a first region above the bright-dark cut-off is at least partly illuminated with visibly colored light scattered at the first coating, a second region below the bright-dark cut-off being illuminated with visible light of a different color transmitted through the second coating.

2. The lamp claimed in claim 1, wherein the light source of the lamp is a high-pressure discharge lamp, a non-halogen incandescent lamp or a halogen lamp.

3. The lamp claimed in claim 1, wherein at least a portion of the first coating is an absorption coating capable of, at least in part, scattering yellow light.

4. The lamp claimed in claim 1, wherein at least a portion of the first coating includes the second coating being an interference coating or a combined absorption and interference coating capable of transmitting blue light.

5. The lamp claimed in claim 1, wherein the first coating comprises a yellow absorption layer.

6. The lamp claimed in claim 1, wherein the second coating includes pinstripes disposed on an area of the outer envelope and the first coating comprises at least a first portion which is an absorption coating which scatters yellow light at least partly and a second portion which is arranged in a striped pattern along the pinstripes.

7. The lamp claimed in claim 6, wherein the second portion transmits bluish light.

8. The lamp claimed in claim 1, configured to illuminate, in the low-beam function, a traffic space in vicinity of the bright-dark cut-off manner by light passing through the coating.

9. A lighting device comprising at least the lamp claimed in claim 1.

10. The lamp claimed in claim 1, wherein the first coating comprises a yellow-absorption layer, and is arranged on a front or a rear region of the lamp's outer envelope.

11. A vehicle headlight lamp having a low beam function, the lamp comprising an outer envelope and a partial coating having a first coating and a second coating provided on the outer envelope, the lamp being capable during operation of the low beam function of generating during operation a bright-dark cut-off line in light emitted by the lamp, a first illumination region being then positioned directly above the bright-dark cut-off line and illuminated with yellow light scattered at the first coating, a second illumination region being positioned directly below the cut-off line and illuminated with bluish light transmitted through the second coating.

12. The lamp claimed in claim 11, wherein the light source of the lamp is a high-pressure discharge lamp, a halogen lamp or an incandescent lamp which is not a halogen lamp.

13. The lamp claimed in claim 11, wherein the first coating is an absorption coating scattering, at least partly, yellow light.

14. The lamp claimed in claim 11, wherein the second coating is an interference coating preferentially transmitting blue light or a combined absorption and interference coating preferentially transmitting blue light.

15. The lamp claimed in claim 11, wherein the first coating comprises a yellow absorption layer and is arranged on front or rear region of the outer envelope.

16. The lamp claimed in claim 11, wherein the first coating comprises at least a portion which is an absorption coating scattering preferentially, at least partly, yellow light and a second portion arranged in a striped pattern along pinstripes of the second coating.

17. The lamp as claimed in claim 16, wherein the second portion extends in the striped pattern along the lamp envelope axis and transmits bluish light.

18. A vehicle headlight lamp having a low beam function, the lamp comprising a lamp envelope, the lamp envelope being provided with means for illuminating, during use of the low beam function, both a first illumination region positioned directly above a bright-dark cut-off line and a second illumination region positioned directly below the bright-dark cut-off line, the first illumination region being illuminated with light of a different color, transmitted through a first coating of the lamp envelope, from the light illuminating the second illumination region and transmitted through a second coating of the lamp envelope.

19. The lamp of claim 18 wherein the light illuminating the first illumination region is yellowish.

20. The lamp of claim 18 wherein the light illuminating the second illumination region is bluish.

21. The lamp of claim 18 wherein the lamp is capable of emitting at least visible light of multiple wavelengths through the lamp envelope, and the first coating and the second coating partially coat the lamp envelope.

22. The lamp of claim 21 wherein the first coating comprises absorption coating scattering, at least partly, yellow light.

23. The lamp of claim 22 wherein one or more pinstripes are arranged on the lamp envelope and at least a portion of the absorption coating is arranged in a striped pattern along the one or more pinstripes.

24. The lamp of claim 21 wherein the second coating comprises an interference coating or a combined absorption and interference coating and which preferentially transmits blue light.

25. The lamp of claim 21 wherein the first coating comprises a yellow absorption layer arranged on a front region of the lamp envelope or on a rear region of the lamp envelope.

* * * * *